US005856631A

United States Patent [19]

Julien

[11] Patent Number: 5,856,631

[45] Date of Patent: Jan. 5, 1999

[54] GUN BARREL

[75] Inventor: Gerald J. Julien, Puyallup, Wash.

[73] Assignee: Nitinol Technologies, Inc., Edgewood, Wash.

[21] Appl. No.: 753,182

[22] Filed: Nov. 20, 1996

Related U.S. Application Data

[60] Provisional application No. 60/006,978 Nov. 20, 1995 and 60/010,750 Jan. 29, 1996.

[51] Int. Cl.[6] ..... F41A 21/04

[52] U.S. Cl. ..... 89/16; 42/76.02; 42/78

[58] Field of Search ..... 89/16, 14.05; 42/76.02, 42/76.01, 78; 29/1.11

[56] References Cited

U.S. PATENT DOCUMENTS

| | | | |
|---|---|---|---|
| 3,174,851 | 3/1965 | Buehler et al. | 148/426 |
| 4,638,712 | 1/1987 | Chawla et al. | 42/77 |
| 4,685,236 | 8/1987 | May | 42/76.02 |
| 4,722,825 | 2/1988 | Goldstein | 42/76.02 |
| 4,747,225 | 5/1988 | Gstettner et al. | 42/76.02 |
| 5,160,802 | 11/1992 | Moscrip | 89/16 |
| 5,509,345 | 4/1996 | Cyktich | 89/14.05 |

FOREIGN PATENT DOCUMENTS

| | | | |
|---|---|---|---|
| 743111 | 1/1956 | United Kingdom | 42/76.02 |

*Primary Examiner*—Stephen M. Johnson
*Attorney, Agent, or Firm*—J. Michael Neary

[57] ABSTRACT

A gun barrel for a gun has an elongated tube with an axial bore extending completely through the tube from the breech end to the muzzle end. The tube and the contact surface in the axial bore, which contains propellant gasses behind the projectile and engages the projectile while guiding it toward the target, are made of Nitinol having a transition temperature lower than the lowest ambient temperature at which a gun with the barrel is designed to be operated, or of a Nitinol formulation consisting essentially of 60% nickel and 40% titanium. A first sleeve may be mechanically coupled to the barrel tube by shape memory contraction thereon to prestress the barrel tube in compression. The first sleeve may be made of a Nitinol composition having a Martensite state and an Austenite state existing naturally on opposite sides of a transition temperature lower than the designed normal lower ambient temperature in which the gun operates, whereby the sleeve composition remains in the Austenite state during operation of the gun and provides substantial compressive preloading of the tube during operation. A second sleeve of a Nitinol composition having a transition temperature higher than the designed normal operating temperature of the gun is encased within the first sleeve, whereby the second sleeve composition remains in the Martensite state during normal operation of the gun and provides substantial damping of vibrations and whipping of the gun barrel in operation

20 Claims, 13 Drawing Sheets

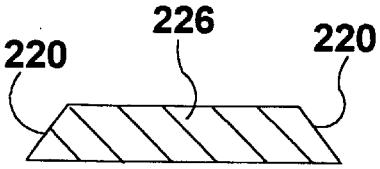
Fig.33
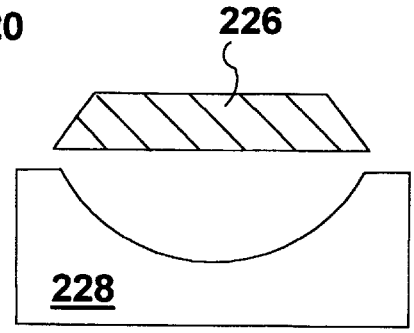
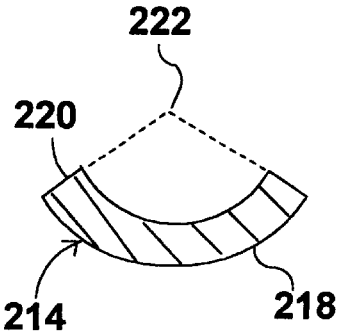
Fig.32
Fig. 34
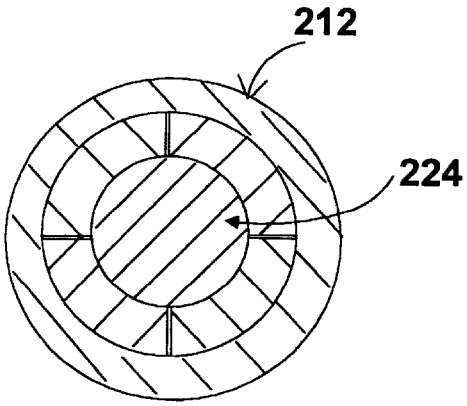
Fig.31
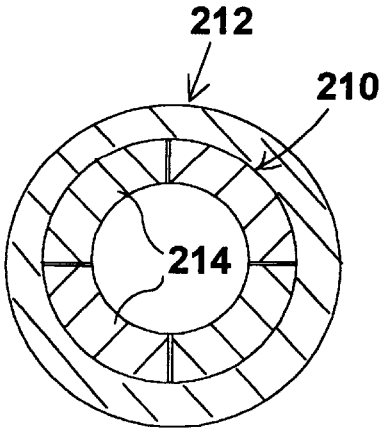
Fig.30

GUN BARREL

This invention was disclosed in part in earlier filed Provisional Patent Application No. 60/006,978 filed on Nov. 20, 1995, now abandoned, and Provisional Patent Application No. 60/010,750 filed on Jan. 29, 1996, now abandoned, each entitled "Gun Barrel".

This invention relates to gun barrels, and particularly to a light weight, ultra-high strength, corrosion resistant gun barrel that is virtually burst-proof, and has low heat conductivity and low coefficient of friction with projectiles, hence heats more slowly than conventional barrels.

BACKGROUND OF THE INVENTION

Gun barrels have been made in substantially the same way since the early 1900's, with only minor improvements in processes and materials since then. The process is basically to mount a large cylindrical steel casting or forging for rotation about its axis and machine the outside to a tapered cylindrical barrel blank. The blank is then mounted in a gun drill and rotated about its axis against a drill to bore axially through the barrel blank. Finally, a broaching operation cuts shallow helical grooves to form rifling between the grooves.

Mostly through trial and error, refinements have been made to manufacturing techniques for making gun barrels to correct for inaccuracies that were noted under certain conditions of use. For example, rapid or extensive firing of the gun heats the gun barrel, and it was found that the uniformity of the barrel thickness around the barrel is important to prevent unequal thermal expansion that can distort the barrel into a curved or even wavy shape and ruin the accuracy of the gun. To minimize this type of distortion, the barrels are turned as accurately as possible after the bore as been bored, and high accuracy guns are provided with thick walled barrels to minimize the effects of whatever variations in barrel wall thickness remain.

Differential thermal expansion is also believed to be responsible for non-uniform twisting of the barrel as it heats during use, caused by the non-uniform thickness of the barrel wall due to the rifling in the bore. The slightly corkscrew shape of the barrel is also detrimental to accuracy of the gun.

The high temperature of the barrel is a consequence of high rate of fire and is considered to be inevitable. At present, the only known techniques to prevent high barrel temperature involve various types of active cooling, including the use of water jackets around the barrel. Little effort has been made to study the source of heat, which is primarily conduction from the burning propellant in the breech and the barrel, and also friction between the projectile and the bore. Reduction of this heat flux into the barrel would retard the rise in temperature of the barrel during use and alleviate some of the deleterious effects of the high temperature on barrel performance.

Conventional steel alloys used in gun barrels, including rifles, side arms, and shotguns as well as barrels for large naval and ground artillery and high rate-of-fire weapons such as machine guns and cannons are heat treatable to increase their strength. However, the trade-off for attaining high strength by heat treatment in steel alloys is an increase in brittleness. Put another way, the ability of the steel alloy to yield without rupturing when its yield strength is exceeded, a property known as toughness, is lost or reduced when the steel is heat treated to achieve high strength. High strength brittle material in a gun barrel is dangerous because overpressure caused by a plugged barrel or excessive powder loads, or weakness in the barrel caused by damage, fatigue, corrosion, or other such factors could cause the barrel to burst catastrophically instead of just bulge. Since the bursting usually occurs at the breach, near the shooter's face, the potential for serious injury, blinding, or death is high. Accordingly, it is the normal practice, although unfortunately not universal, for gun manufacturers to sacrifice potential strength and hardness of their barrel materials for toughness by not heat treating to maximum strength, usually less than 32 KSI. As a result, the barrel wall thickness must be made commensurably thicker and the soft condition of the barrel material is susceptible to rapid erosion from passage of the projectiles.

A goal in designing modern military weapons is to attain higher muzzle velocity for the projectile to attain longer range, flatter trajectory, higher impact energies and greater accuracy. One conventional technique for attaining higher muzzle velocity is to increase the barrel length to give a longer time during which the propellant gas pressure can act on and accelerate the projectile. Apart from cost, the primary limitation on barrel length is weight. The increased moment of inertia of a long barrel increases the load on the training mechanisms used to point the barrel, especially when tracking a moving target or shifting between targets in a rapidly evolving battlefield situation. Moreover, the vibration and resonant conditions are compounded in a long barrel.

Another technique for increasing the muzzle velocity is to increase the propellant energy. The limitations of this technique are the burst strength of the barrel, primarily in the breech area since the pressure spike of the reacting propellant occurs primarily while the projectile is near the breech. To flatten that pressure spike, the propellant may be adjusted to react more slowly and provide a more steady pressure against the projectile. However, the pressure pulse created by the muzzle blast from the propellant when the projectile exits the barrel must be controlled to prevent injury to personnel or equipment in the vicinity. Barrel materials that could withstand an extreme pressure pulse from a high energy propellant would enable a gun to greatly increase the muzzle velocity without creating a muzzle blast that exceeded the established safety limits.

Steel is a dense material, and gun barrels made of steel are heavy. The weight is increased even more because of the need to make the barrel wall thicker since it cannot be safely heat treated to maximum strength. The heavy barrel is a mere annoyance for hunters and recreational shooters, but it seriously impacts the capability of military systems that must be burdened by the great weight of conventional steel gun barrels. Aircraft must sacrifice load or range to carry the heavy guns using these barrels, reducing the quantity of ammunition the aircraft can carry. The swing weight of large naval guns becomes so great that the train and elevation drives of the guns become immense and slow. The strength needed to resist the high energy propellant loads necessary to achieve ultra-high velocities needed for long range, flat trajectory, high accuracy shooting are practically unattainable because of the great thickness of barrel wall needed, which makes the gun so heavy as to be unmanageable. Moreover, the soft condition of the barrels causes rapid wear of the bore, especially in rapid fire situations where the barrel gets very hot and loses even more of its already low strength. The resultant loss of accuracy of these military weapons make further expenditure of ammunition a total waste.

Corrosion resistance of high carbon steels is notoriously poor. Special coatings and other techniques are available in great profusion to protect the gun barrels from corrosive influences such as salt water, most acids, products of propellant combustion, and many other substances common in the environment. However, most such coatings are most useful if applied frequently, especially immediately after each use of the gun, but it is rarely convenient to do so. Consequently, there is a period following use of the gun before it is cleaned and coated with the protective coating during which rapid corrosion can occur, especially since the combustion products of the propellant, and the projectile fragments remaining in the barrel can create galvanic corrosion. The resultant pitting of the bore then tends to trap additional corrosive materials, further exacerbating the corrosive effects. The effort to find barrel materials that can resist the effects of these corrosive substances has never produced a material that meets the other requirements for a gun barrel.

Vibration and shock of firing large caliber machine guns and artillery tend to be inimical to accuracy. The vibration must be allowed to damp out before the next round is fired or there would be little certainty where the gun will be pointed when the projectile leaves the muzzle. Shock transmitted through the barrel on initiation of the propellant charge may influence the interaction of the projectile in the bore, especially the reflected wave rebounding back from the muzzle. These vibration and shock waves may also interfere with the interaction of the barrel on its mounting structure, and also reduce the life of the gun by fatigue.

Hot plastic deformation of a conventional steel barrel is a serious problem, especially in military guns. At elevated temperatures, the steel barrel is effectively hot forged slightly each time the gun is fired, increasing the internal diameter of the bore slightly and, over time, increasing it enough that the bore, even without erosion, is no longer within bore tolerance. The projectile is loose in such an over-sized bore and has poor accuracy. Moreover, the blow-by of propellant gasses around the projectile in the bore is so great that the projectile does not develop the velocity it needs to attain its specified range, and instead falls short of its intended target.

Long gun barrels present special accuracy problems, especially large caliber guns on the order of 155 mm or larger with cantilevered barrels. Such guns require relatively thick-walled barrels to contain the high propellant gas pressure and provide a large heat sink to prolong the period during which high rate-of-fire can be tolerated before the accuracy deteriorates to the point beyond which further expenditure of ammunition is useless. Such conventional steel thick walled gun barrels are very heavy and have a tendency to droop at the muzzle end when trained at low elevations, especially when the barrel becomes hot and the Young's modulus of the steel drops. These have been intractable problems in the past because of the need for high burst strength and the high density of the only know materials that were proven for use in gun barrels. A composite metal gun barrel that is comparatively light weight, has a high Young's modulus for stiffness, and a high burst strength would be a very welcome development, especially for large caliber guns.

Attempts have been made for years to produce composite gun barrels, always without practical success. The materials used are usually very expensive and labor intensive to build into a barrel. More seriously, however, environmental and service conditions have a destructive effect on composite barrels and no satisfactory solutions to these problems have been developed. The problems include a mismatch of coefficients of thermal expansion between the several elements in the composite barrel, resulting in poor mechanical coupling between those elements and insufficient compressive preload. The attempts to correct these problems are complex and impractical in a production environment. The composite elements tend to be brittle, shock sensitive and vulnerable to attack by common environmental substances such as salt water, as well as acids, hydraulic fluid and other substances common around guns, especially on naval vessels.

Thus, for many years there has been a serious need for a gun barrel, made of tough, high strength materials, that is relatively light weight so that the gun barrel may be made thinner than current barrels and the thin barrel combined with the low density material substantially reduces the weight of the barrel. The high strength and toughness of the barrel materials would permit use of higher energy propellant loads for increased muzzle velocity, range and accuracy. Ideally, the gun barrel would be self damping and immune to the effects of salt water, acids, and the corrosive combustion products of the projectile propellant. Finally, such an ideal gun barrel would have a low coefficient of friction with the projectile materials, a high heat capacity, and low coefficient of thermal expansion to minimize the distorting effects of differential thermal expansion.

SUMMARY OF THE INVENTION

Accordingly, it is an object of this invention to provide an improved light weight gun barrel that is tough, strong and corrosion resistant. Another object of the invention is to provide a process of manufacturing a gun barrel from a low density, tough, high strength, corrosion resistant material Yet another object of this invention is to provide a composite barrel having elements tailored specifically to provide bore erosion resistance, damping, and high bursting strength.

These and other objects are attained in a gun barrel that is made of a nickel-titanium alloy or intermetallic compound such as Nitinol. The barrel may have a barrel liner tube of one nickel-titanium alloy or intermetallic compound such as 60 Nitinol or a low transition temperature nickel-titanium composition in its austenitic state, and may be prestressed in compression by a sleeve of the same or another nickel-titanium intermetallic compound or alloy. An intermediate sleeve of 55 Nitinol may be used to provide integral damping to absorb shock and vibration to prevent barrel whipping and other undesired off-axis deflection.

DESCRIPTION OF THE DRAWINGS

The invention and its many attendant objects and advantages will become more clear upon reading the following detailed description of the preferred embodiment in conjunction with the following drawings, wherein:

FIG. 30 is a sectional elevation on a plane perpendicular to the bore of another embodiment of a gun barrel made in accordance with this invention;

FIG. 31 is a cross section of barrel liner segments assembled onto a mandrel and inserted into a barrel tube;

FIG. 32 is a cross section of one of the barrel liner segments shown in FIGS. 30 and 31;

FIG. 33 is a cross section of a barrel liner piece before forming into the cylindrical form shown in FIG. 32; and FIG. 34 is an elevation, partly in section of the liner piece shown in FIG. 33 being formed in a forming die.

DESCRIPTION OF THE PREFERRED EMBODIMENTS

Figure 1:
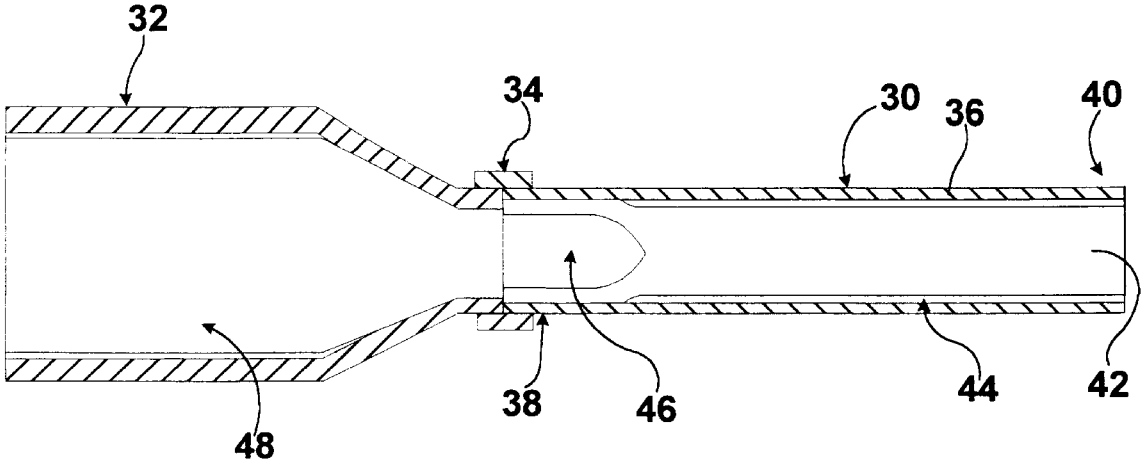
FIG. 1 is a sectional elevation of a gun barrel according to this invention secured to a conventional breech by a Nitinol coupling.

Turning now to the drawings, wherein like reference numerals designate identical or corresponding parts, and more particularly to FIG. 1 thereof, a barrel 30 is coupled to a breech 32 by a connector 34. The breech 32 may be a conventional steel structure machined from conventional gun materials such as 4140 steel or 416 stainless steel. The barrel 30 is an elongated tube 36 made of Type 60 Nitinol bored axially completely through from the breech end 38 to the muzzle end 40. A series of wide, shallow helical grooves are cut into the bore 42 of the tube 36, leaving helical lands 44 between the grooves, constituting rifling by which the bullet 46 is spin stabilized as it is propelled through the bore 42. The wall thickness of the barrel tube 36 may be uniform as shown in FIG. 1, or may be tapered toward the muzzle end 40 to accommodate the higher propellant pressures at the breach end when a cartridge 48 is fired in the breach.

The connector 34 is an annular ring of shape memory Nitinol such as Type 56 Nitinol. Type 56 Nitinol is an intermetallic compound of 56% nickel and 44% titanium having a Martensitic state and an Austenitic state existing naturally on opposite sides of a narrow transition temperature range. The material undergoes a spontaneous transformation between states when the temperature changes across a transition temperature, which for Type 56 Nitinol has a transition temperature on the order of −30° C. In the Austenitic state, in which the material is used, it has very high strength and resists corrosion better than any other structural metal.

The connector 34 is made by boring or EDM cutting a cylindrical rod to produce a bore with an internal diameter about 6% less than the outside diameter of the barrel tube 36, and cutting off a short section, perhaps 2" long to form the connector 34. The connector 34 is cooled below the transition temperature, conveniently by immersion in liquid nitrogen. Below the transition temperature, the material is in its Martensitic state and can easily be mechanically expanded in diameter, for example by a mechanical expanding mandrel of known construction. While still below the transition temperature, the connector 34 is slipped over the narrow end of the breech 32, and the barrel tube 36 is inserted in the bore of the connector 34. The connector 34 is now allowed to warm above its transition temperature, whereupon it spontaneously reverts to its memory size it had before being expanded when in the Martensitic state. It exerts a powerful radial force on the junction of the barrel tube and the breech, holding them together and reinforcing that region of the barrel 30 and the breech with prestressed Austenitic Nitinol having a yield strength of about 220 KSI. Conveniently, the mating ends of the barrel tube 36 and the breech 32 may be provided with shallow circumferential surface ridges on the outside surface to give the connector 34 a better grip.

Figure 2:
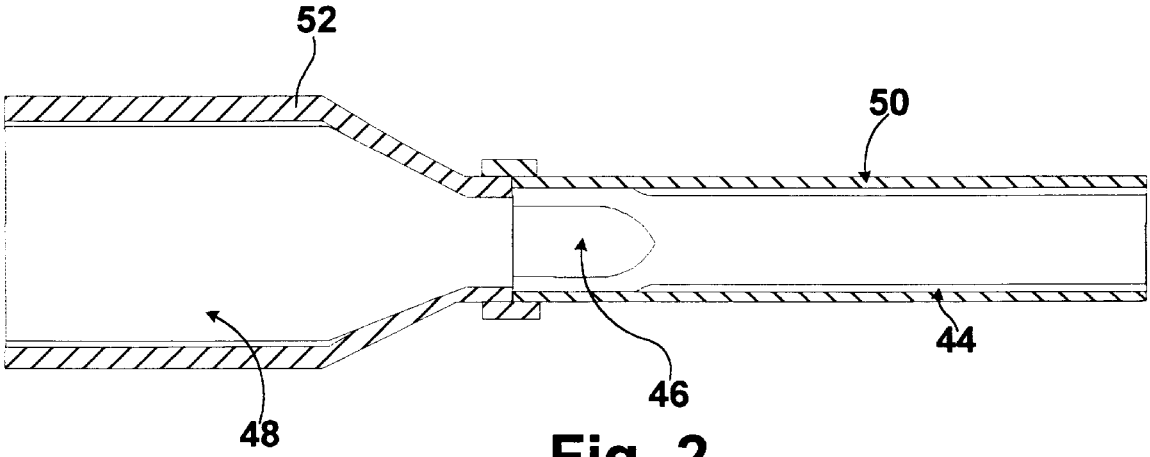
FIG. 2 is a sectional elevation of a gun barrel according to this invention having an integral breech.
Figure 3:
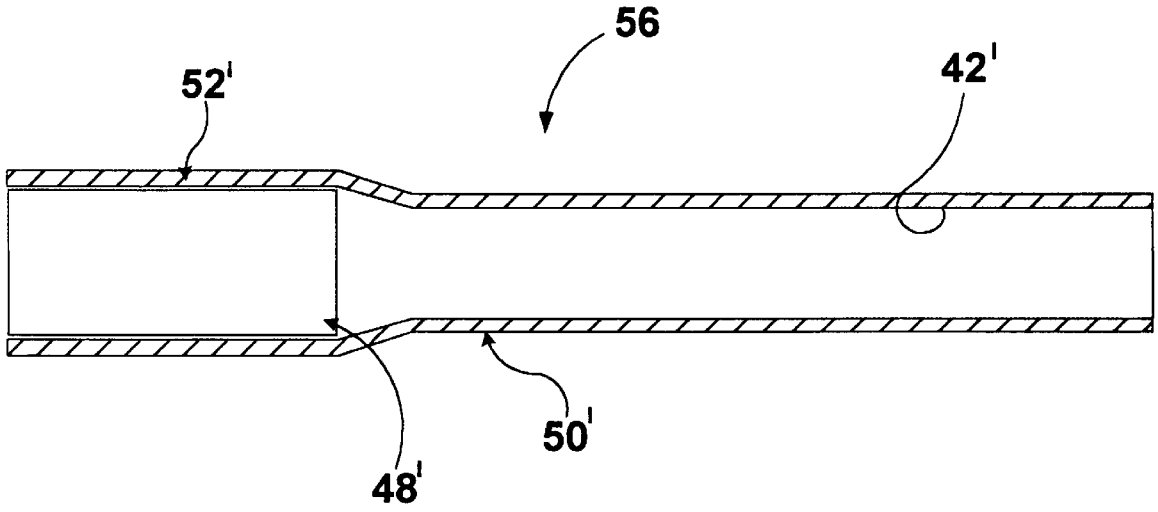
FIG. 3 is a sectional elevation of a shotgun barrel made in accordance with this invention.

Other forms of the first embodiment are shown in FIGS. 2 and 3 wherein an integral barrel 50 and breech 52 for a rifle 54, or an integral barrel 50' and breech 52' for a shotgun 56 are machined from a single blank of 60 Nitinol. The advantage of this design over that shown in FIG. 1 is that the manufacturing and alignment of the barrel and breech are simplified. The disadvantage is that the amount of 60 Nitinol used to make the barrel increases substantially, and the amount of machining is increased. The machining of 60 Nitinol is difficult because it tends to use up the cutting tools quickly and cutting time is long. Another disadvantage is the absence of the coupling connector 34 which adds strength and toughness to an area of the gun where it is useful to have, but this shortcoming may be supplied if desired by a reinforcing band added for that purpose, or by a sleeve shown in the second embodiment described below.

The barrel blanks for the tube 36 and the integral barrel 50/breech 52 may be made from a solid rod of Type 60 Nitinol, which is an intermetallic compound of 60% nickel and 40% titanium. It has a tensile strength of about 137–178 KSI and an ultimate yield strength of 222 KSI. Its elongation before rupture is only about 1%, but the strength is so great that it can safely contain the peak pressure of about 60 KSI of the burning propellant without significant elastic deformation, so the 1% elongation is never approached in a gun designed to withstand the peak pressures in the bore.

The coefficient of friction of conventional projectiles such as lead and gilding metal jacketed lead bullets with 60 Nitinol is substantially lower than it is with steel barrels, so the energy of the propellant is not wasted by conversion to heat in friction with the bore of the gun barrel. Instead, the projectile slips through the bore with little resistance, gaining significantly greater muzzle velocity without heating the gun barrel as much as the same projectile would heat steel barrels.

The 60 Nitinol in the gun barrel 30 can be heat treated to a hardness of above 60 on the Rockwell C scale. It may be prudent to heat treat to a hardness somewhat less than 60+ to avoid brittleness, but a hardness even as low as the low to mid 40's on the Rockwell C scale would be an improvement over the soft barrels now in use. Erosion of the bore of a 60 Nitinol gun barrel would be significantly slower because of this greater hardness, and even more so because the coefficient of friction of most projectile materials in a 60 Nitinol bore is substantially lower than that in a steel bore.

The manufacturing process used to make the 60 Nitinol gun barrel are unlike those used to make conventional gun barrels because the 60 Nitinol material behaves differently than conventional steel barrel materials. The barrel blank is typically received from the supplier as a rough octagonal cross-section rod, since 60 Nitinol cannot be drawn or extruded but instead must be hot forged to the rod diameter from the cast ingot. The blank is centered in the chuck of a conventional barrel boring machine modified to slow the rotation and feed speed down to about 200–300 RPM and feed at a speed of about 0.25 inches/minute. Cutting is accomplished by rotating the barrel against the drill and flushing with copious quantities of cutting fluid, such as Cool Tool II made by Monroe Fluid Technology in Hilton, N.Y. It is important not to use too fast a rotation or feed speed to avoid raising the temperature of the working surface of the 60 Nitinol blank high enough to heat treat it, which would increase the hardness and make further cutting virtually impossible. The cutter is preferably a diamond bit, although tungsten carbide or titanium carbide coated cutters may be used with a slower feed rate.

When the bore is drilled completely through, the barrel may be left on the same chuck and turned to the desired outside diameter, which for a 0.223 barrel for an M-16 military rifle could be about ¾ inch in diameter, 75% smaller than the standard diameter barrel for that gun and about 45% lighter, but substantially stronger and stiffer. The barrel is turned at about 200 RPM against a diamond cutter to peal the barrel wall down to a uniform thickness to minimize any thermal distortion when the barrel gets hot due to uneven heating. The thickness will be about 0.25"–0.26" which provides a barrel with a bursting strength in excess of that required in an M-16 rifle.

The coefficient of thermal expansion of 60 Nitinol is about $11\times10^{-6}$/°C. The heat capacity of 60 Nitinol is higher than steel, on the order of 0.2 cal/g°C., and the thermal conductivity is low, only about 0.18 watt/cm$^2$°C. so thermal effects, if any, develop slowly in the 60 Nitinol gun barrel. High temperature resistance of 60 Nitinol is excellent. Its yield strength remains constant to about 400° C., and then declines with the ultimate tensile strength gradually to above 700° C. so the surface material in the bore 42 retains its desirable properties noted above even when it becomes very hot.

Figure 4:
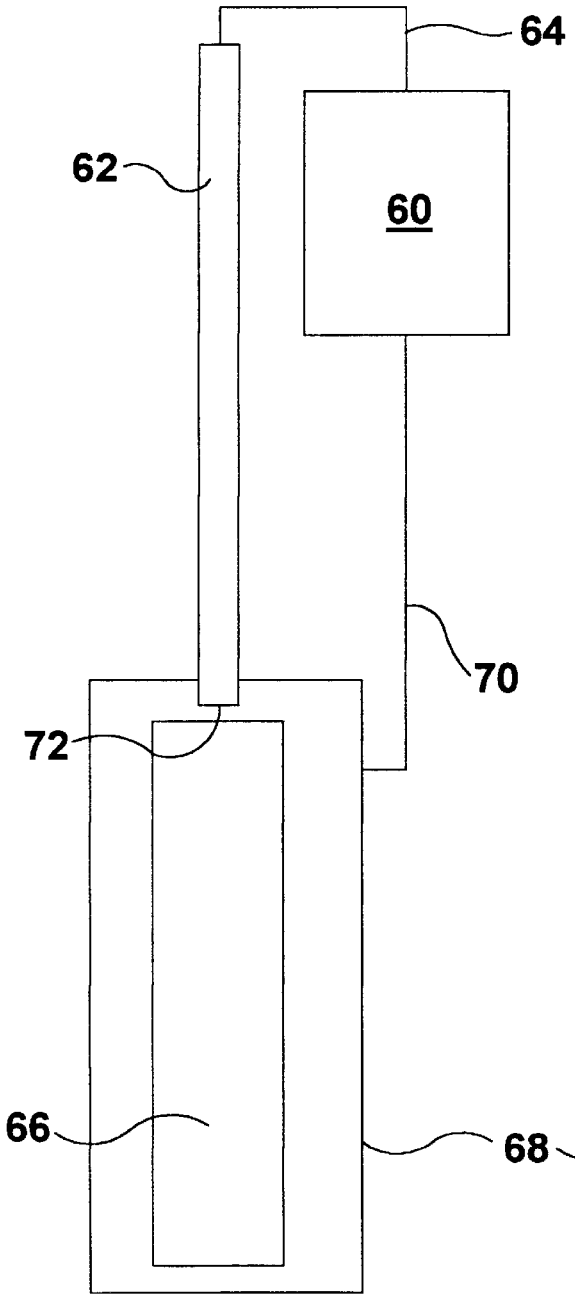
FIG. 4 is a schematic drawing an electrical discharge machine adapted for drilling barrel bores and sleeves.
Figure 5:
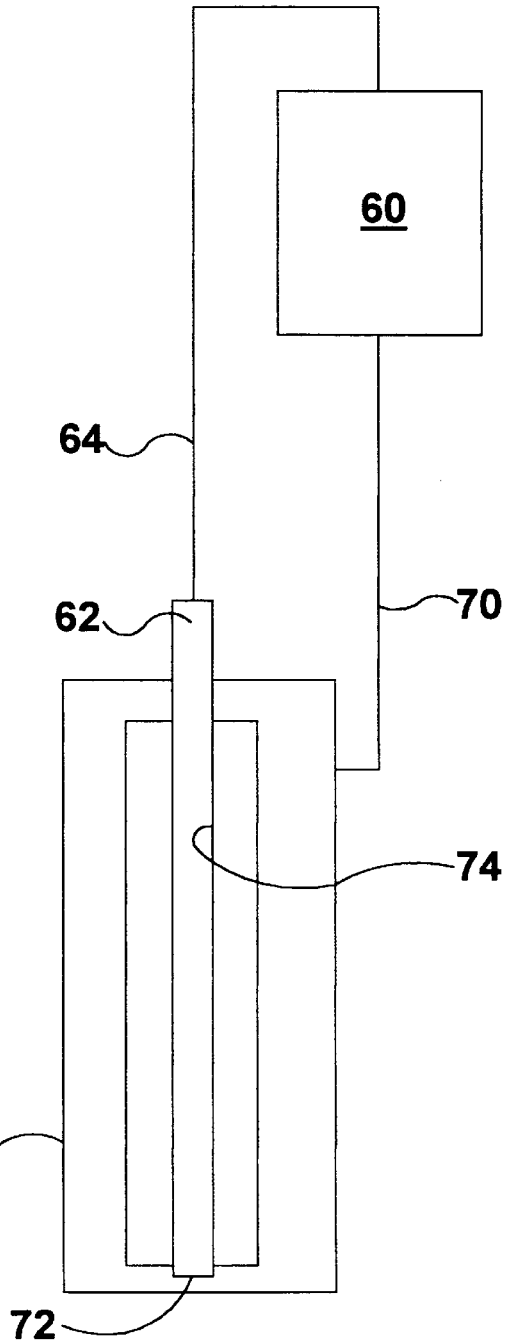
FIG. 5 is a schematic drawing of the EDM machine shown in FIG. 4, after drilling the barrel bore.

An alternative technique for cutting the bore 42 through the 60 Nitinol blank is electrical discharge machining, using an apparatus shown schematically in FIGS. 4 and 5. Electrical discharge machining apparatus is made by several companies, including Mitsubishi EDM, MC Machinery Systems, Inc. and Hansvedt, Inc. commercially available from Perine Machine Tool Corporation in Portland, Oreg. in various forms. The EDM machines use a high power generator 60 that provides high frequency, high voltage, and high amperage electrically to a probe 62 to which it is connected by way of a conductor 64. A barrel blank 66 is placed in a vessel 68 filled with coolant and is electrically connected to the generator 60 by a conductor 70. The probe is preferably mounted vertically to avoid the bending effects of gravity that would act on a horizontally mounted probe. It is immersed in coolant that is pumped into the bore while the probe is advanced into the material. The high frequency current flows through the water from the conductor on the probe and into the workpiece where it burns away the material immediately adjacent the conductor, producing a clean, smooth precise cut. The probe 62 is advanced vertically into the vessel in axial alignment with the barrel blank 66, and current from a conductor on the leading end 72 of the probe 62 flows into the adjacent surface of the barrel blank 66, burning away material in the center to cut a clean and precise bore 74.

There are two basic forms of EDM cutting: sinker EDM and wire EDM. The sinker EDM form uses a probe 62 having a cutting end 72 with a diameter about equal to the diameter of the bore 74 to be cut. The probe is preferably tubular in shape to cut a cylindrical plug out of the axis of the blank 66 instead of cutting away the entire mass of material from the bore 74, and the cylindrical plug cut out to make the bore 74 can be used for other purposes. The other EDM cutting technique contemplated for use to make the gun barrel of this invention uses a thin sinker like the probe 62, except that it is only about ⅛th inch in diameter to cut a small diameter hole axially through the barrel blank 66 adjacent to what will become the surface of the bore 74. A wire is inserted through the hole and is held under tension at opposite ends of the hole by rollers that allow the wire to be advanced so it does not burn through while the cutting is proceeding. The generator 60 is energized and the wire is guided around a closed annular path by a guided support structure (not shown) to produce a cylindrical cut that is the inner wall of the bore 74. An elongated cylindrical plug is cut loose by the annular wire cut and is removed and used for other purposes, such as a barrel blank for a smaller caliber gun barrel.

SECOND EMBODIMENT

Figure 6:
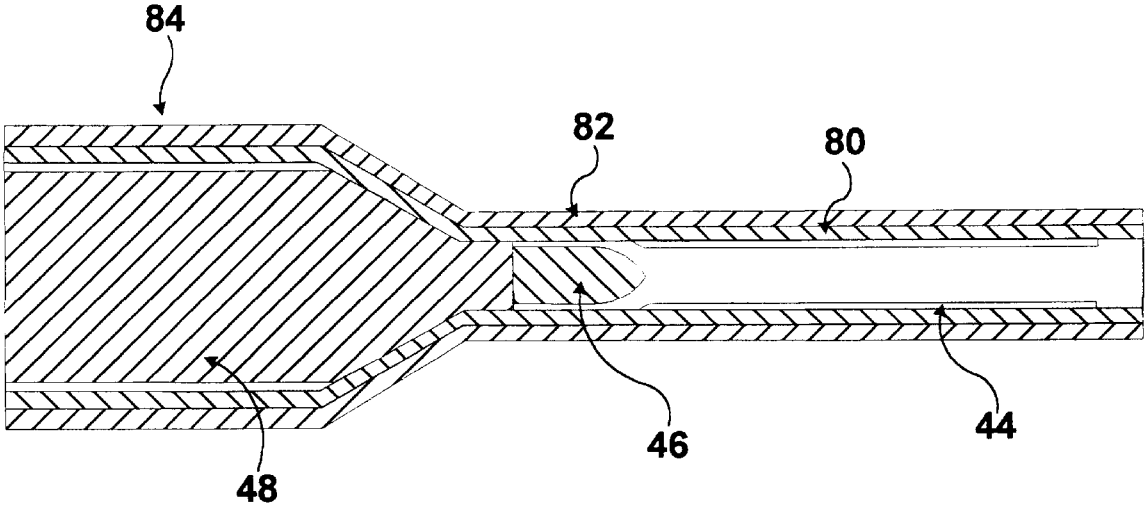
FIG. 6 is a sectional elevation of a second embodiment of a gun barrel made in accordance with this invention.

Turning now to FIG. 6, a second embodiment of the invention is shown having a liner tube 80 made of 60 Nitinol and a reinforcing outer sleeve 82 around the liner tube 80. As shown in FIG. 6, the liner tube 80 is integral with the breech 84, but it could also be made separately as shown in FIG. 1 and attached to the breech with the sleeve 82.

The reinforcing sleeve 82 provides additional strength and exerts a compressive preload on the 60 Nitinol liner tube 80. Since 60 Nitinol has an elongation of less than 1% and tends to rupture when stressed beyond its yield point, a compressive preload exerted by the sleeve will provide additional strength to militate against the liner reaching the yield point and makes possible the use of a thin walled liner. In addition, use of a tough reinforcing sleeve 82 having an elongation greater than about 20% will provide additional protection against bursting of the barrel in the event that the yield strength of the liner 80 is exceeded, even with the compressive preload applied by the sleeve 82, since the sleeve can yield without rupturing.

The reinforcing sleeve 82 is made of a nickel-titanium composition having two basic crystalline phases: a monoclinic Martensite state and an ordered body centered cubic Austenite state. These states are temperature dependent and undergo spontaneous enantiomorphic thermally induced allotropic phase transformations from one to the other and back again as the temperature of the material changes across a narrow transition temperature range. The sleeve 82 can be plastically deformed in its Martensitic state from an original shape to a deformed shape, and then will return to the original shape when warmed above its transition temperature. The sleeve 82, if constrained against returning completely to its original form by the barrel liner 80 inside the sleeve, can exert a compressive force, up to its own yield strength, on the barrel liner 80 upon undergoing the phase change from Martensite to Austenite.

The material of the sleeve 82 is preferably a nickel-titanium intermetallic compound. Two types of sleeve material are contemplated by this invention: one form having a transition temperature colder than the lowest temperature which the gun is expected to experience in operation, for example, −30° C., and above −195° C., the boiling point of nitrogen, for a reason which is explained below. This first type would exist in its high strength Austenitic form during operation of the gun. One suitable material is 56 Nitinol, a binary intermetallic compound having 56% nickel and 44% titanium. Another suitable material is a ternary composition sold by Metaltex International Corp. in Albany, Oreg. under the name 220VC, and yet another one is a similar composition sold by Raychem Corp. in Menlo Park, Calif. under the name "Alloy A".

A second form of sleeve material has a high transition temperature, higher than the operating temperature normally encountered in the use of the gun, so it would exist in its Martensitic state during normal operation of the gun. This second form is based on 55 Nitinol, which is a 50/50 atomic percentage intermetallic compound of nickel and titanium, with some doping materials added to raise the transition temperature, as known by those skilled in the metallurgy of nickel-titanium compounds.

Figure 8:
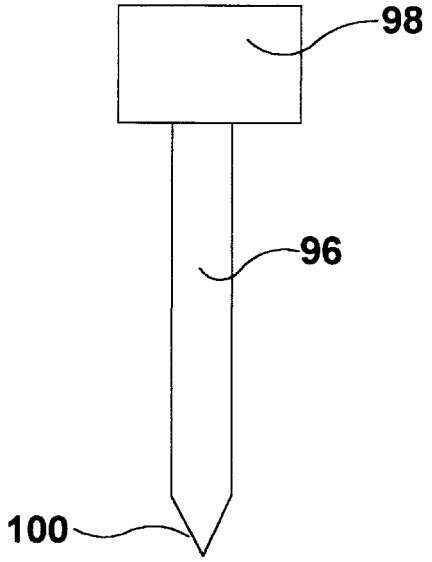
FIGS. 7–9 are schematic diagrams of a punch process for hot forming an axial bore in a Nitinol billet.
Figure 8:
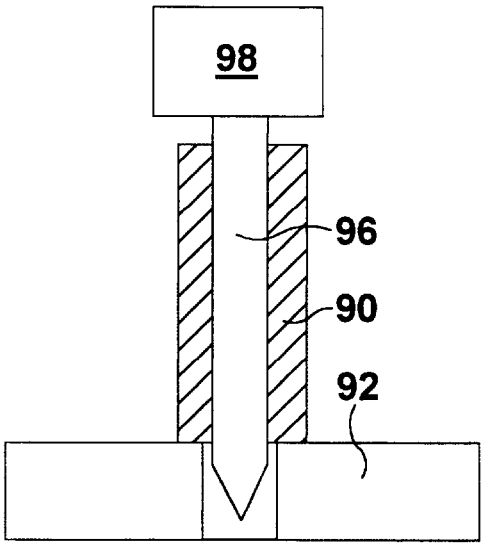
Figure 7:
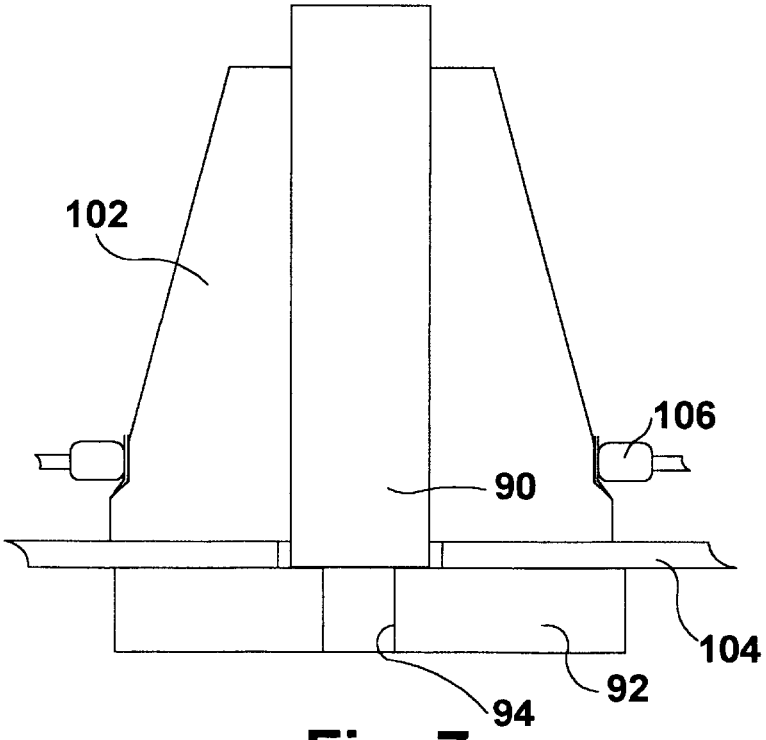
Figure 9:
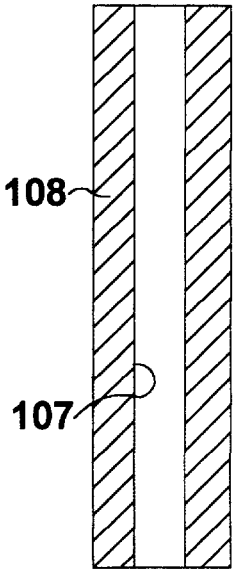

The sleeve may be manufactured economically using a hot forming technique illustrated in FIGS. 7–9. A billet 90 of the sleeve material is positioned on an arbor 92 of a press over a clearance opening 94. A hardened punch 96 of heat resistant material such as tool steel or Inconel is attached to the ram 98 of the press aligned over the clearance opening 94. The punch is preferably sharpened or rounded at its distal end 100 to facilitate forming the hot material of the billet 90. Depending on the aspect ratio of the billet 90, it may be advisable to support the vertical sides of the billet 90 with retractable tooling 102 supported on guides 104 and biased against the billet by pneumatic actuators 106 or the like. Short thick billets will not normally require such support.

The billet 90 is heated to a high temperature, on the order of 1000° C., at which it becomes ductile and is positioned on the press arbor 92. It may be brought back to ductile temperature with induction heating if it cools somewhat during transport from the furnace to the press, but the thermal conductivity of Nitinol is so low that the billet can normally be punched without supplemental heating. When positioned on the arbor 92, the billet is pierced, as shown in FIG. 8, with a single rapid stroke of the press ram 98 which drives the punch 96 completely through the axial center of the billet 90 to form an axial bore 107. The ram is quickly withdrawn and the pierced billet, shown in FIG. 9, is allowed to cool in preparation for the final processing.

When cooled, the pierced billet, now termed a sleeve blank 108, is chucked onto a gun drill and the bore 107 formed by the punch 96 is cut to the desired diameter by a boring bar on which diamond cutters are mounted. A large power motor is required and a slow rotation speed for turning the sleeve blank and a slow feed speed are necessary for advancing the boring bar into the bore for cutting the bore to the required diameter to prevent the material from developing a strain hardened condition that makes further cutting difficult or impossible and damaging the cutters. Copious quantities of cutting fluid should be pumped through the bore 107 to carry away chips and remove heat.

One convenient manufacturing technique for expanding the sleeve 82 is to immerse the sleeve in a liquid nitrogen bath to cool it below the transition temperature for expanding in the Martensitic state. While in the liquid nitrogen bath, conveniently in a narrow vertical vessel, an expanding mandrel is inserted down into the sleeve and a rolling element is drawn through the mandrel, expanding it against the sleeve to increase the diameter of the sleeve between 4–8%, preferably about 6%. The rolling element is pulled through the mandrel, forcing it outward against the inside of the sleeve and forcing the sleeve to the selected larger diameter, plus springback. Then, while the sleeve is still in the liquid nitrogen bath, the liner is inserted down into the sleeve and the two elements are located at the exact desired position relative to each other. When positioned correctly, both elements are withdrawn together from the $N_2$ bath and allowed to warm to a temperature above the transition temperature of the sleeve material.

On passing through the transition temperature, the sleeve material reverts toward its memory shape and the sleeve 82 shrinks down onto the barrel liner 80, exerting a radially compressive force on the liner 80. The sleeve material exerts a force about equal to its tensile strength when it is constrained against returning to its original form by the liner 80 inside the sleeve 82. The compressive force exerted by the sleeve creates a compressive stress in the liner that must be overcome by the pressure force inside the liner bore 74 by the projectile propellant gasses before the liner 80 is put into tension. Thus, the total pressure that the barrel liner preloaded in compression with the pretensioned sleeve can withstand is greatly increased over a plain 60 Nitinol barrel without the pretensioned sleeve.

Figure 12:
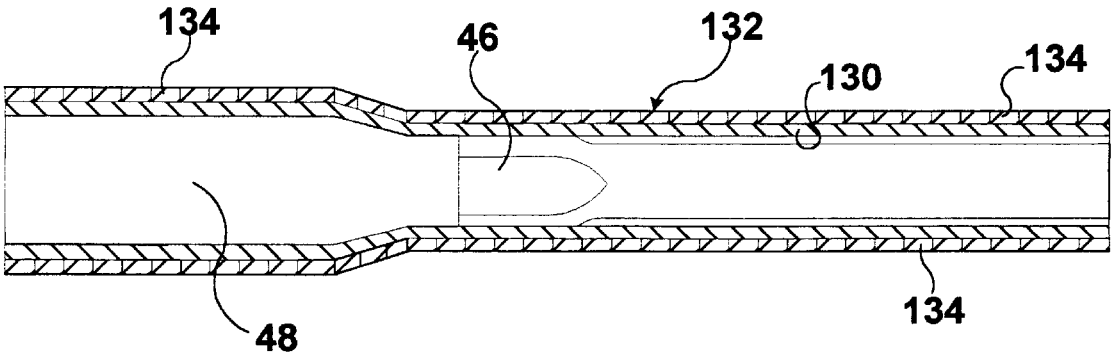
FIG. 12 is a sectional elevation of a fifth embodiment gun barrel according to this invention.

Another form of sleeve is shown in FIG. 12 as a series of stacked rings made of the same material as the sleeve 82. These rings together form a sleeve when arranged contiguously along the barrel tube. Although the analysis for this type of sleeve is more complicated because of the stress discontinuities at the junctions of the sleeve rings, the ease of expanding the short sleeve rings in the cold Martensitic state and installing them on the barrel tube 80 offsets any such complication, especially since the rings can be made with thicker walls to counterbalance whatever effect the stress discontinuities might introduce.

THIRD EMBODIMENT

Figure 10:
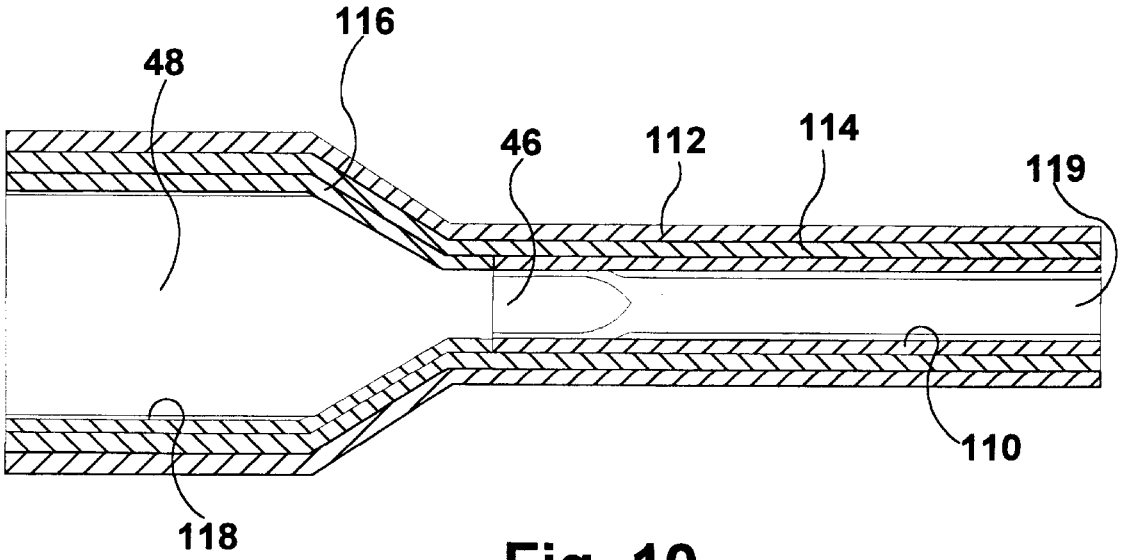
FIG. 10 is a sectional elevation of a third embodiment of the invention having an Austenitic Nitinol outer sleeve and a Martensite Nitinol inner sleeve around a barrel liner of 60 Nitinol.

A third embodiment of the invention, shown in FIG. 10, includes a liner tube 110 made of 60 Nitinol and an outer sleeve 112 made of a low transition temperature nickel-titanium composition, such as 56 Nitinol, Alloy A, or 220VC described above, with an intermediate sleeve 114 between the liner 110 and the outer sleeve 112. The intermediate sleeve 114 is made of a high transition temperature nickel-titanium composition having a high temperature Austenite state and a lower temperature Martensite state. The transition temperature of the composition selected for the intermediate sleeve 114 is preferably above the normal operating temperature of the gun barrel so that it remains in its Martensite state during normal operation. A suitable material for this application is 55 Nitinol, doped with gold, iridium, or other known dopants to raise the transition temperature. However, cobalt should not be used as a dopant since it adversely affects the properties of the 55 Nitinol.

The Nitinol intermediate sleeve 114 in its Martensitic state provides integral damping of the barrel during firing to absorb shock and vibration and to prevent the barrel from developing natural frequency oscillations and whipping when it is fired. Such motions are inimical to accuracy of the gun, especially in rapid firing situations, because they increase the uncertainty of the direction in which the barrel muzzle is pointed when the projectile leaves the muzzle. Nitinol in its Martensite state is an excellent damping material, having a specific damping capacity of about 40% when strained beyond 4%. Oscillations of a stiff structure, which otherwise would continue for minutes at a time, can be damped quickly, often within a small number of cycles, when a Martensitic damper is coupled to the structure and is strained cyclically with the structure while it oscillates.

The thickness of the Martensitic sleeve is selected to provide sufficient strain during firing of the gun to achieve the desired damping capacity. The material does not exhibit the damping capacity for small strain percentages, so a thin walled damping sleeve 114 is preferred, because a damping sleeve that is too thick may not be strained sufficiently to provide the desired high damping capacity.

A thin walled damping sleeve offers another advantage to the performance of the gun barrel, namely an increase in strength when subjected to large stresses. The sleeve is already stressed when it is installed, so not much additional stress is necessary to transform the material to the stress-induced Martensite state, wherein the strength increases from about 120 KSI to about 275 KSI or higher. Although the radial strain of the 60 Nitinol liner is not sufficient to strain the 55 Nitinol sleeve enough to transform it to stress-induced Martensite, the elongation it experiences during whipping or resonant vibrations of the barrel in the course of high repetition rate firing will often be sufficient to strain the 55 Nitinol sleeve material enough to transform it to the strain-induced state.

The gun barrel shown in FIG. 10 has a separate breech 116 which could also be made of 60 Nitinol. The breech 116 has an outside diameter and an axial bore 118 with an inside diameter sized to receive a cartridge 48 or a powder canister (as used in naval guns) with a propellant charge for reacting in breach 116 to generate propellant gasses for propelling the projectile 46 from the gun.

The barrel liner 110 projects from the breech 116 in axial alignment therewith, with the axial bore 119 of the liner 110 aligned axially with the breech bore 118 for guiding the projectile propelled from the breech by the propellant gasses.

Making the breach 116 from a separate piece of 60 Nitinol saves material since it obviates the need to machine away a large amount of material around the barrel to reduce the outside diameter of the barrel to that shown in FIG. 10. The breech 116 could also be conventional gun steel and is reinforced by the sleeves 112 and 114, so it is capable of withstanding peak pressures of within the bore 118 of greater magnitude than a breech of comparable weight made of conventional breech materials and construction.

FOURTH EMBODIMENT

Figure 11:
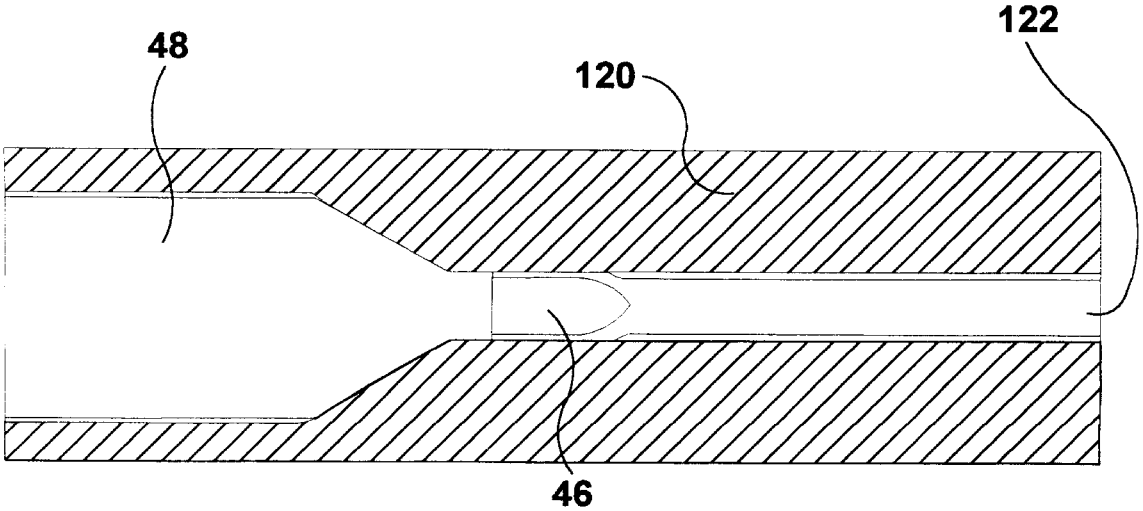
FIG. 11 is a sectional elevation of a fourth embodiment of a gun barrel according to this invention.

A fourth embodiment of the invention, illustrated in FIG. 11, includes a tube 120 made of a low transition temperature form of nickel-titanium composition. One such material is known as 56 Nitinol, and two other materials which would be suitable are the aforementioned compositions sold by Metaltex International Corp. under the name 220VC and Alloy A sold by Raychem. All of these compositions exist in a Martensitic state below a transition temperature and exist in an Austenitic state above the transition temperature. The transition temperature can be adjusted by the percentages of nickel and titanium, and also of the percentages of dopants, such as iron, aluminum, manganese, as well as other dopants mentioned herein and others known by those skilled in the art. These materials may be strain hardened through appropriate thermal processing, and exhibit unusually rapid work hardening. Barrel blanks of low transition temperature binary nickel-titanium compositions can be ordered from the supplier, such as Metaltex, with any desired transition temperature between −30° C. and −195° C., which would be suitable for making gun barrels according to this fourth embodiment of the invention, and there is no need to normalize the barrel with another heat treatment after cutting the bore 122.

The barrel blank as received from the supplier is mounted on a gun drill and rotated against a diamond or tungsten carbide bit at low speed and low feed speed, for example, 0.75 inches/minute for a 0.223 bore. Attempting to cut the material at too high a rotation speed or too high a feed speed can result in work hardening that can increase the strength and hardness of the material to the point that it is nearly impossible to cut further. The bit must be kept sharp or the cutting speed will drop drastically and the energy input by the spindle will be converted to heat and the material be become virtually uncutable. Coolant/cutting fluid is flushed through the bore 122 at a high rate to flush out chips and prevent heat build-up which also can increase the difficulty of cutting. In addition, the bore 122 can be drilled using the EDM processes noted above for the 60 Nitinol tube, and also formed using the punch piercing technique noted for the sleeve manufacturing process discussed in connection with the second embodiment above.

The bore 122 can be drilled with a small diameter drill bit and then the bore enlarged with a boring bar using a titanium nitride coated cutting bit. The cutting speed must be kept slow: about 80–100 surface feet/second and a slow feed speed, on the order of about ½"/minute.

Rifling of the bore may be accomplished using the conventional broach cutting tools normally used for rifling, twisting as the broaching tool gradually as it is drawn back through the bore 122 to produce the desired pitch of the rifling. The cutting rate will be much slower for the nickel-titanium material than it is for convention steel barrels, but rifling of any desired depth can be produced with sufficient repetitions of the broaching operation.

A preferable technique for machining the rifling in the bore is electro-chemical machining. An electro-chemical probe, such as the one sold in a system made by Cacion, Inc. in Madison Heights, Mich., is inserted into the bore 122 filled with an electrolyte, and the system power supply is energized to produce a current flow from the probe to the bore. The current flowing in the electrolyte acts to remove metal adjacent the conductors on the probe. The cutting depth can be adjusted by the speed at which the probe is drawn through the bore, and the number of repetitions of moving the probe through the bore.

Low transition temperature intermetallic compounds of nickel-titanium in their Austenitic state and in stress induced Martensite have a yield strength of about 105–130 KSI and higher, and a hardness of about 35–42 on the Rockwell C scale. The material can undergo an elastic elongation of about 8% and a plastic elongation of as much as 60% before rupture. This extreme toughness makes the material extremely attractive for gun barrel material because of its propensity to yield and bulge when over pressured, rather than bursting in the face of the shooter. In its low temperature Martensitic state, these compositions have a lower yield strength, about 54 KSI, and hardness, about 25 Rockwell C, so it is easy to deform the sleeve to expand the sleeve diameter with an expanding mandrel or the like at low temperature, such as a liquid nitrogen bath, in the Martensitic state to prepare for the sleeve expansion step.

FIFTH EMBODIMENT

Figure 13:
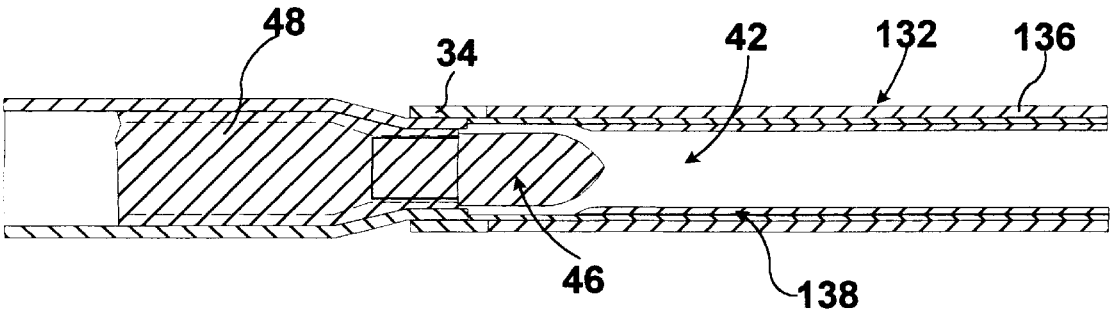
FIG. 13 is a sectional elevation of another form of the fifth embodiment of the invention according to this invention.

Two forms of the fifth embodiment of the invention, shown in FIGS. 12 and 13, include a tube 130 made of a low transition temperature nickel-titanium composition, such as the ones noted above for the fourth embodiment, used in the Austenitic state. The form shown in FIG. 12 has an outer sleeve 132 made of rings 134 surrounding the liner tube 130. The form shown in FIG. 13 has an outer sleeve 132 that is a continuous sleeve 136 surrounding a barrel liner 138, coupled by way of a coupling sleeve 34 to a separate breech as in the embodiment of FIG. 1. The sleeves 132, both in ring form and in continuous sleeve form, are formed of a nickel-titanium material and both exist in a state of tension when installed on the tubes 130 and 138, exerting a compressive preload thereon, as discussed above in connection with the second embodiment. The material of the sleeves 132 could be either a low transition temperature nickel-titanium composition in the Austenitic state as noted for the second embodiment above, or it could be a nickel-titanium material having a high transition temperature, used primarily in the Martensitic state for compressively preloading the liner tubes 130 and 138, and for damping. Although the tensile strength of the material in its Martensitic state is lower that when it is in its Austenitic state, it is sufficient to exert a tensile force of 20KSI which can substantially preload the barrel liner in compression and add significantly to its burst strength.

The high specific damping capacity of nickel-titanium intermetallic compounds in the Martensitic state provide a benefit in additional to compressive preloading of the barrel liners 130 and 138, namely, damping of whipping and resonant frequency vibrations of the barrel, especially during high speed firing. The sleeve 132 provides both of these functions when it is coupled with high interfacial pressure to the liner by shape memory contraction when is raised above the transition temperature after being expanded in the Martensitic state as discussed above.

Figure 14:
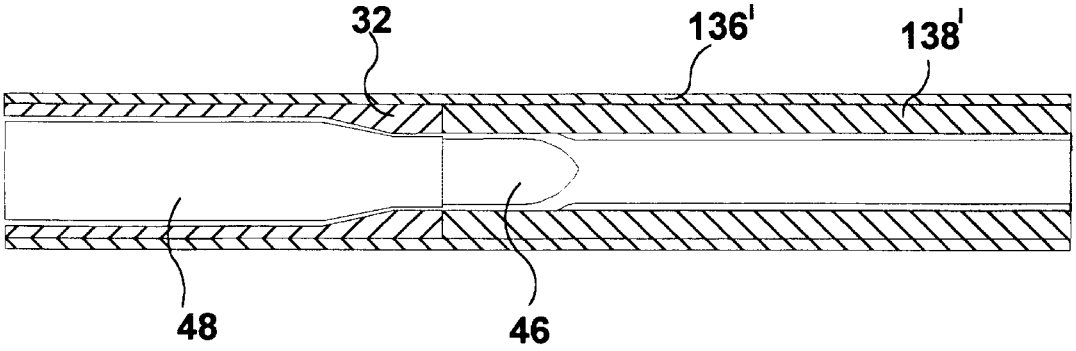
FIG. 14 is a sectional elevation of yet a third form of the fifth embodiment of a gun barrel in accordance with this invention.

A third form of the fifth embodiment, shown in FIG. 14, has a continuous sleeve 136' that extends the full length of a barrel liner 138' and connects the barrel liner 138' to a separate breech 32 using the same mechanism as the coupling sleeve 34 of FIGS. 1 and 13. The breech 32 could be a conventional steel breach whose strength is greatly reinforced with the compressive preloading of the sleeve, or could be made of the same material as that used for the barrel liner 138'. The manufacturing of the sleeve 136' is simplified compared to the sleeves in the embodiment of FIG. 10 because the outer diameter of the barrel liner matches the outer diameter of the breech 32, so the sleeve 136' can be made as a perfectly uniform diameter cylindrical sleeve. It is made and installed on the aligned breech and barrel liner in the same manner as describe for the previous embodiments.

SIXTH EMBODIMENT

Figure 15:
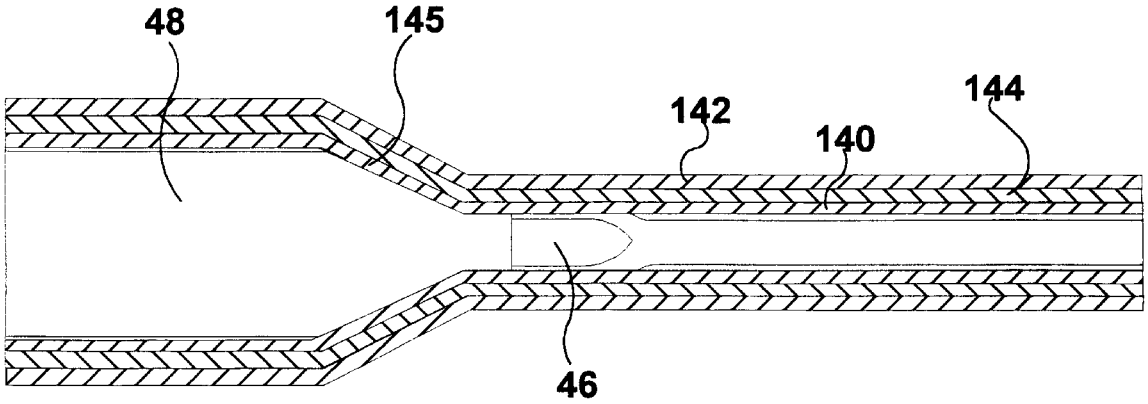
FIG. 15 a sectional elevation of a sixth embodiment of the invention made in accordance with this invention.

A sixth embodiment, shown in FIG. 15, has a barrel liner 140 and an outer sleeve 142 of low transition temperature intermetallic compounds of nickel-titanium in the Austenitic state, and an inner sleeve 144 integral with a breech 145 and made of a high transition temperature intermetallic compound of nickel-titanium in the Martensitic state. The outer sleeve 142 provides compressive preload for increasing the burst strength of the liner 140, and also provides damping, as described in connection with the embodiment of FIG. 10.

SEVENTH EMBODIMENT

Figure 16:
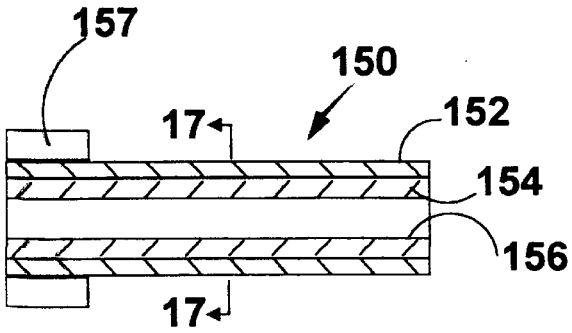
FIG. 16 is a sectional elevation of a seventh embodiment of the invention made in accordance with this invention, having a steel outer tube with a Nitinol liner sleeve.
Figure 17:
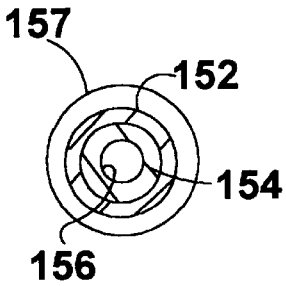
FIG. 17 is an end elevation of the gun barrel along lines 17—17 in FIG. 16.

Turning now to FIG. 16, a seventh embodiment of the invention is shown having a composite metal gun barrel 150, including a steel outer tube 152 surrounding a Nitinol liner sleeve 154 through which an axial bore 156 extends. The outer tube 152 has a coupling structure 157 of known construction, shown schematically in FIG. 16, by which the barrel 150 is attached to the gun. The barrel 150 and coupling structure may be made of 4140 steel or other such material with a high Young's modulus. This embodiment is of particular value for long cantilevered gun barrels which tend to sag or droop at the distal end under their own weight, especially after extended periods of high rate of fire operation when the barrel gets hot, because of the improved stiffness provided by the steel outer tube 152.

The liner sleeve 154 is preferably made of a low transition temperature Nitinol composition described above, such as the ternary compositions sold by Metaltex International Corporation in Albany, Oreg. under the name 220VC, and a similar composition sold by Raychem Corp. in Menlo Park, Calif. under the name "Alloy A." The binary intermetallic compound known as 56 Nitinol, having 56% nickel and 44% titanium can also be used. These materials are hard and tough, and all have shape memory characteristics, making them excellent candidates for gun barrel liner materials. Moreover, they have low thermal conductivity and heat up slowly in the presence of high temperature gasses to militate against heat flux into the barrel through the walls of the bore 156, thereby delaying the overheating of the barrel during extended periods of use. The chemically inert and temperature resistant nature of Nitinol makes it tolerant of high temperature in the presence of corrosive influences that steel barrels would not tolerate. Of course, the 60 Nitinol liner tube 80 described above could also be used in place of the liner sleeve 154 in this seventh embodiment.

Figure 18:
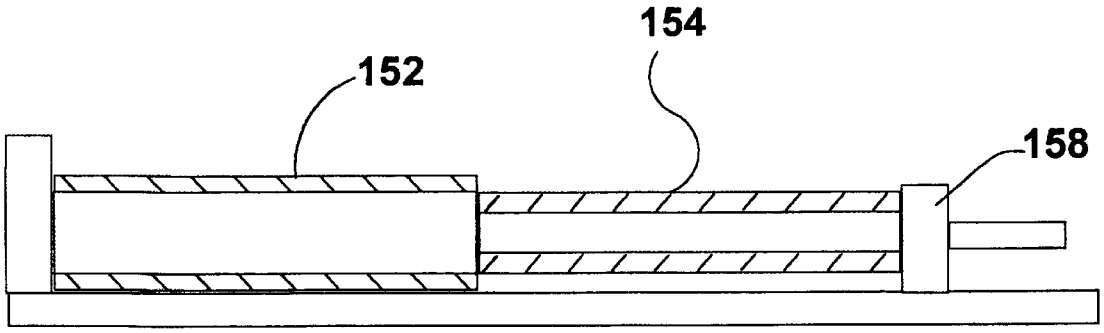
FIG. 18 is a schematic view of a press apparatus for pressing the Nitinol liner of FIG. 16 into the steel outer tube.

The embodiment shown in FIG. 16 may be made in several ways, described below. The first method is by pressing the liner sleeve 154 into the steel outer tube 152, as shown in FIG. 18. The outer diameter of the liner sleeve 154 can be made slightly larger than the inner diameter of the outer tube 152 to create an interference fit when the sleeve 154 is pressed into the outer tube 152. The interference fit prestresses the outer tube 152 in tension, thereby improving its resistance to drooping at the muzzle. The interference fit also prestresses the liner sleeve 154 in compression, thereby improving its bursting strength. The liner sleeve 154 is aligned with the outer tube 152 and is coated with a suitable lubricant such as graphite or boron nitride to reduce the sliding friction of the sleeve 154 in the tube 152. A linearly guided hydraulically operated press head 158 presses the liner sleeve 154 straight into the outer steel tube 152.

Figure 19:
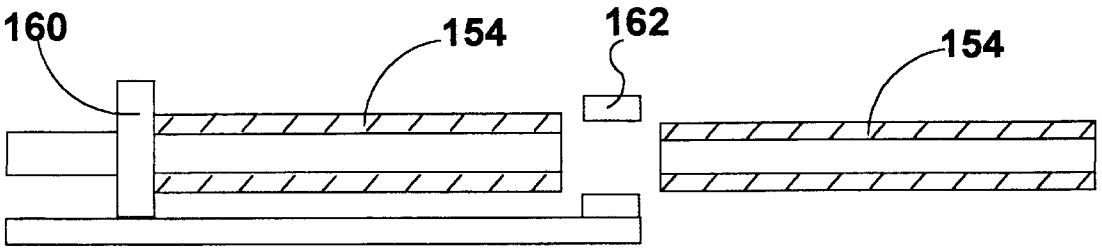
FIGS. 19 and 20 are sectional elevations of a facility for manufacturing the gun barrel shown in FIG. 16 using the shape memory characteristic of the Nitinol liner sleeve material.
Figure 20:
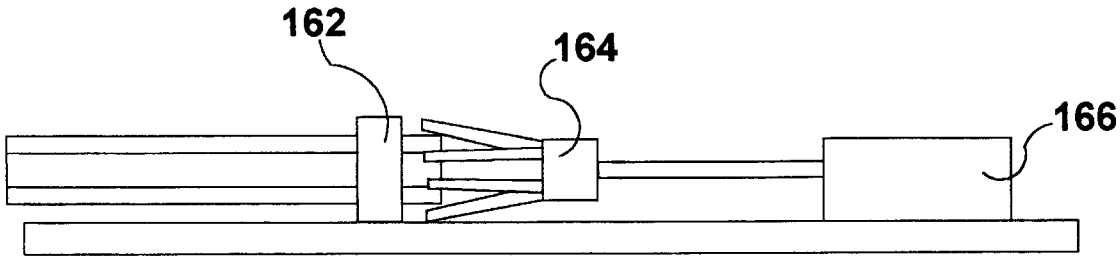

The liner sleeve 154 may be secured in the steel outer tube 152 by utilizing the shape memory effect of Nitinol. The Nitinol liner sleeve 154 is first immersed in a cryogenic bath, of liquid nitrogen for example, to reduce its temperature below the transition temperature so the Nitinol material transforms to its Martensitic state. In this state, the material is relatively soft and can be drawn to a longer shape with a smaller outer diameter. The drawing operation can done using either or both of the apparatus shown in FIG. 19 and 20. In FIG. 19, a press head 160 driven by a hydraulic ram (not shown) drives the Nitinol liner sleeve 154 into and through an annular roller die 162 of known construction. The inside diameter of the die is smaller than the outer diameter of the Nitinol liner sleeve 154 and produces a pseudoplastic deformation of the liner sleeve 154 from its original shape. Alternatively, or in addition, the liner sleeve 154 may be gripped by a clamp 164, shown in FIG. 20, and drawn through the die 162 by a puller mechanism 166 of known construction. The combination of both operations, that is, pushing the liner sleeve i56 into the die 162 from one side and pulling from the other side offers the best combination of diameter reduction by longitudinal stretching under the pulling force exerted by the puller 166 and radial compression exerted by the die 162.

The liner sleeve 154 must be in its Martensitic state during the drawing operation. The sleeve can be cooled in a liquid nitrogen bath and then quickly removed and mounted in the drawing apparatus for drawing to a smaller diameter. However, a preferred embodiment would be to draw the sleeve 154 while in the liquid nitrogen bath. This would require seals in the two ends of the tank holding the liquid nitrogen through which press head rod and the puller mechanism rod extend, and the tank would have to be twice as long as the liner sleeve 154.

Figure 21:
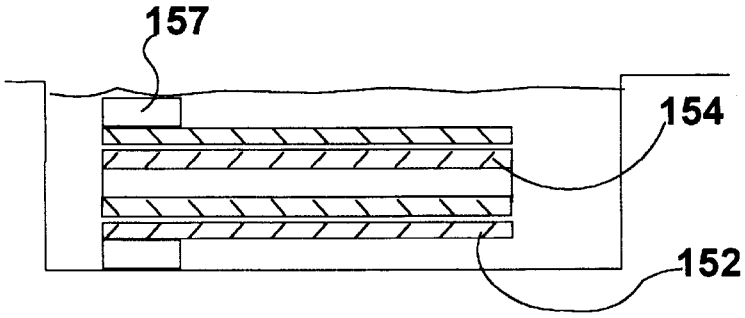
FIG. 21 is a sectional elevation of the liner sleeve produced by the facility shown in FIG. 19 and/or FIG. 20 positioned within a steel outer tube and ready for shape-memory expansion to produce a permanent bimetallic gun barrel having a steel outer tube and a Nitinol liner sleeve.

After drawing, the liner sleeve 154 could be removed from the tank and positioned inside the steel outer tube 152 or, preferably, could be positioned inside the steel outer tube 152 while still in the cryogenic bath tank, as shown in FIG. 21. The assembled parts are removed from the tank and allowed to warm to room temperature. As the liner sleeve 154 passes through its transition temperature, it reverts back to is Austenitic state and spontaneously reverts to its original shorter, larger diameter shape, unless restrained. In this case, it is partially restrained by the bore of the steel outer tube which is sized accordingly. The Nitinol liner sleeve 154 exerts an outward radial force on the steel outer tube 152, putting it into tensile preload. The outer tube 152 exerts a radially inward compressive force on the liner sleeve, putting it into compressive preload. The preload stress in the liner sleeve 154 and the outer tube 152 improves the stiffness of the composite metal barrel to resist drooping at the muzzle end, and also improves the burst strength of the barrel 150.

Another form of the seventh embodiment is shown in FIGS. 22–26 wherein the liner tube 154 is sized to slide with a snug fit into the steel outer tube 165. Although this form of the gun barrel does not benefit from compressive prestressing of the liner sleeve 154 or tensile prestressing of the steel outer tube 165, it has value in simplifying the manufacturing for purposes of testing, wherein liner sleeves 154 of various types and calibers can be tested in a single gun. It would also be of interest in sport guns wherein drooping of the gun barrel at the muzzle end is not a factor and where interchangeable barrels would be a desirable feature.

Figure 22:
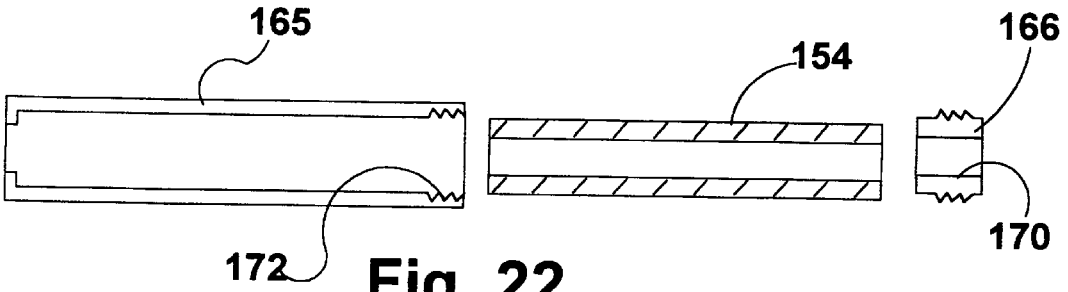
FIG. 22 is an exploded sectional elevation of a second form of the seventh embodiment of the gun barrel according to this invention, showing the Nitinol liner sleeve retained within the steel outer tube by a threaded retainer cap.
Figure 23:
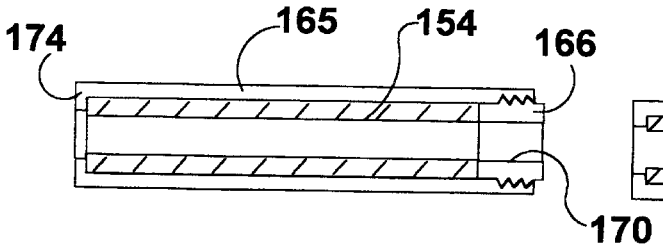
FIG. 23 is a sectional elevation of a gun barrel assembled from the exploded elements shown in FIG. 21.
Figure 24:
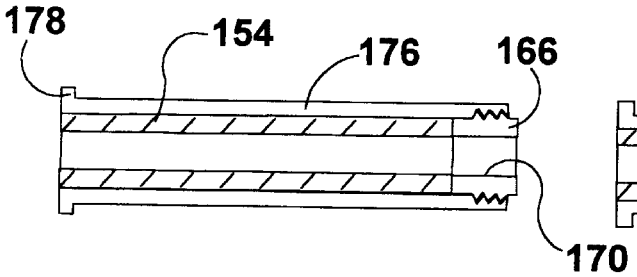

A substantial frictional force is exerted by the projectile on the liner sleeve 154 when the projectile travels toward the muzzle, and in the embodiments of FIGS. 22–26, wherein the liner sleeve 154 is not fixed in the outer tube by an interference fit or the like, this force is reacted by the outer tube to prevent the projectile from taking the liner sleeve 154 with it when the gun is fired. This reaction force for retaining the liner sleeve 154 in the steel outer tube may be provided by end caps at the muzzle end of the outer tube. Two different end caps 166 and 168 are shown in place in FIGS. 23 and 25. The end cap 166, shown in FIGS. 22–24, is a steel nipple having a center bore 170 larger than the bore 156 through the liner sleeve 154. Suitable spanner recesses are provided in the front end of the end cap 166 to facilitate threading the end cap into an internally threaded end portion 172 on the muzzle end of the outer tube 165. An internally projecting radial flange 174 at the breech end of the outer tube 165 traps the breech end of the liner sleeve 154 in the outer tube 165 so the barrel can be handled as a unit. Another form of outer tube 176 shown in FIG. 24 has an outwardly projecting radial flange 178 at its breech end by which the barrel may be attached to the gun. In this configuration, a gland nut (not shown) of know construction captures the flange 178 and clamps it to the breech of the gun, trapping the breach end of the liner sleeve 154 against the breach.

Figure 25:
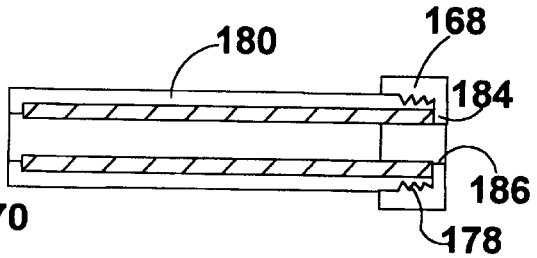
FIGS. 24–26 are sectional elevations of alternate configurations of gun barrels having Nitinol liner sleeves retained by threaded retainer caps in steel outer tubes.
Figure 26:
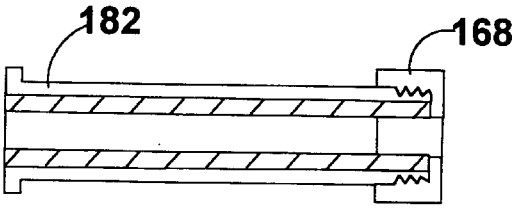

Another configuration of an end cap for retaining the sleeve liner 154 in the outer tube is shown at 168 in FIGS. 25 and 26. The end cap 168 is internally threaded and engages external threads 178 at the muzzle end of the outer tubes 180 and 182. An inwardly projecting radial flange 184 engages the muzzle end of the liner sleeve 154 to trap the liner sleeve in the outer tube against axial translation relative thereto when a projectile is fired from the gun barrel.

Figure 28:
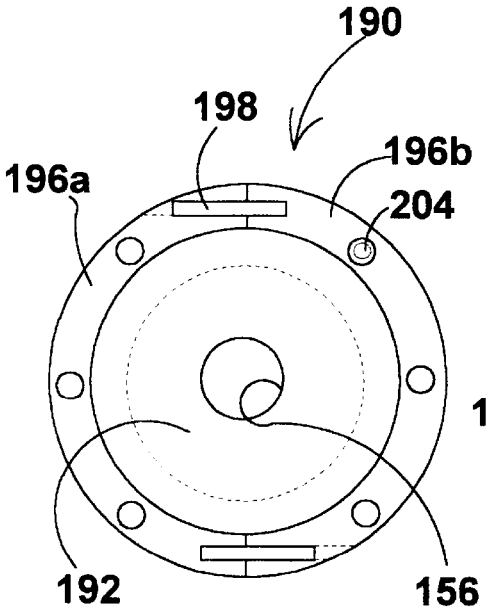
FIG. 28 is an end elevation of the gun barrel section shown in FIG. 27.
Figure 27:
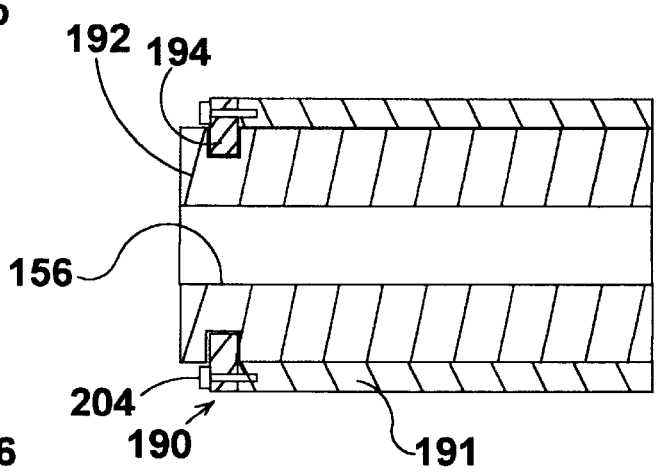
FIG. 27 is a sectional side elevation of a section of another form of the embodiment shown in FIG. 16, showing the Nitinol liner sleeve attached to the steel outer tube of the gun barrel by a compression clamp.
Figure 29:
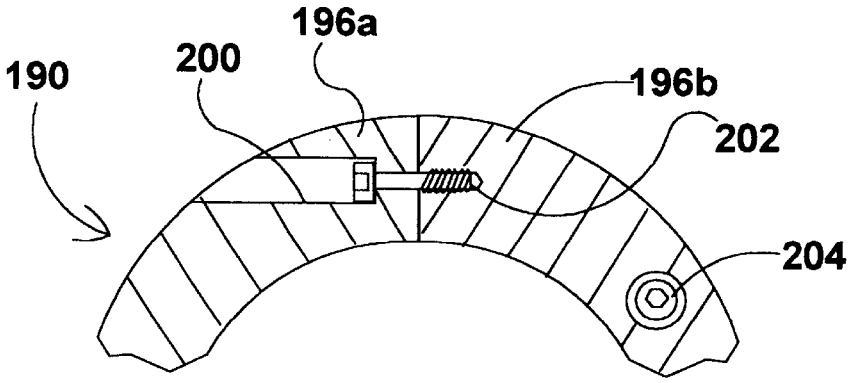
FIG. 29 is an enlarged sectional end elevation of a portion of the two clamp halves shown in FIG. 28.

Another form of the seventh embodiment, shown in FIGS. 27–29, uses a compression clamp 190 at one end of the gun barrel to secure the liner sleeve to the steel outer tube 191. The liner sleeve, shown at 192 in FIGS. 27 and 28, has a shallow annular groove or cannelure 194 adjacent its muzzle or breech end. The width of the cannelure is equal to the width of the compression clamp 190 which extends into the cannelure 194 with a snug fit. The clamp 190 is made in two identical diametrical halves 196*a* and 196*b* which are fastened together by two machine screws, such as Allen head screws 198, extending through a shouldered hole in one clamp half and threaded into a threaded hole 202 in the other clamp half, as shown in FIG. 29. A series of bolts or machine screws 204 may be provided to attach the clamp 190 to the steel outer tube 191, especially if the clamp is near the breech end of the gun. Conveniently, the clamp 190 can be incorporated into the coupling structure 157 by which the barrel is attached to the gun.

The discussion above mentions small arm caliber hunting and military weapons, but the invention is also expressly intended for use in larger caliber weapons such as 0.50 caliber machine guns, 20 and 30 millimeter cannons, high firing repetition rate cannons in particular, and in field artillery, mortars, rocket launchers, and naval guns. It would also find application in ultra-high velocity guns such as rail guns and in large caliber, high rate-of-fire liquid propellant guns. The benefits of the invention may be more important to high muzzle velocity and larger caliber weapons than to the smaller caliber weapons because the problem solved by the invention have more serious consequences in big guns, high rate-of-fire guns, and high muzzle velocity guns than in smaller individual weapons.

Artillery and large naval gun barrels are expensive, in part because of the high fabrication cost of making the large monolithic forging which forms the barrel blank, and because of the cost of turning and boring the blank. An embodiment of the invention, shown in FIG. 30, is a gun barrel 208 having an inner liner 210 surrounded by an outer tube 212. The inner liner is made of a plurality of segments 214, shown separately in FIG. 32, having concentric inner and outer cylindrical surfaces 216 and 218, and having radial side surfaces 220 on planes that intersect on a line 222 at the center of curvature of the cylindrical surfaces 216 and 218, that is, on the axis of the barrel bore. The number of segments 214 in a barrel will vary depending on the thickness of the segment 214 and the diameter of the barrel, but 4–6 segments will usually suffice. It is preferable to use an aspect ratio, that is, segment thickness divided by radius of curvature of the outer cylindrical surface 218 that is large enough to withstand the buckling forces exerted by the projectile passing through the bore, and the twisting forces exerted by the projectile on the rifling ridges. The thickness of the outer tube 212 needs to be sufficient to withstand the hoop stress created by the cup pressures of the burning propellant behind the projectile, and also to support the barrel against sagging under the influence of gravity.

The barrel is assembled by producing the segments 214, as described below, and assembling them on a mandrel 224, as shown in FIG. 31. The mandrel is preferably a two piece construction with a helical outer member having a cylindrical outer surface and a tapered inner surface, and an inner tapered member that can be inserted into the helical outer member to provide radial support for the segments 214 but can be withdrawn to allow the helical outer member to retract radially so it can be pulled out of the bore after assembly of the barrel components. A tool of this general construction is known as a lap and is used for precision honing of holes. The scale of the lap used as a mandrel in this application would be much bigger than normal laps.

The assembled segments on the mandrel 224 are immersed in liquid nitrogen or otherwise cooled, while the outer tube 212 is heated to an elevated temperature of above 300° C.–400° C. The outer tube 212 and the mandrel/segment assembly are quickly telescoped together, preferably on a guide apparatus that facilitates rapid and precise telescoping movement of the components together. The heat transfer from the outer tube 212 to the segments 214 causes a rapid temperature equalization, which contracts the outer tube 212 and expands the segments 214 into intimate and high pressure contact. After temperature equalization, the inner tapered member of the mandrel is dislodged and the helical outer member is pulled out, leaving the segments jammed together in place in a state of compression. The resulting barrel 208 has an outer tube 212 that is prestressed in tension, and a hard, slippery and corrosion resistant liner sleeve 210 prestressed in compression. If desired, the bore through the liner sleeve 210 can be reamed and rifled using conventional tools made for those functions.

The outer tube is preferably a steel alloy such as 416 stainless steel or 4140 gun steel with a high Young's modulous and a high coefficient of thermal expansion. It is formed in the tube shape by conventional gun drilling or by rolling a plate of material and welding along the facing edges, and then reaming the tube to produce an accurate cylindrical bore. The segments may be machined from a forged ingot of low transition temperature Nitinol, such as the 220VC described previously, or from an ingot of forged Type 60 Nitinol. The 220VC material machines well by conventional machining processes, so no special procedures are needed. The Type 60 Nitinol is much more difficult to machine and is best cut with polycrystaline cubic boron nitride (PCBN) cutters powered with high horsepower motors at high cutter surface speeds and low feed rates and shallow depths of cut.

A preferred method of making the segments 214, illustrated schematically in FIGS. 33, 34 and 32, starts with a flat rolled slab or plate of Nitinol which is cut into elongated liner pieces 226 having opposite edges 220 disposed at an angle which will lie on radial planes intersecting at the bore axis after the slab 226 is formed into a cylindrical segment, as shown in FIG. 32. Alternatively, the cutting or grinding operation for the edges 220 could be postponed until after the segments are formed into the cylindrical shape. The cutting can be done with abrasive water jet or wire EDM. However, the prefered cutting technique is laser cutting with a high power laser and a jet of gas such as nitrogen or argon to blow the molten metal out of the kerf. The laser makes a very clean cut and is much faster than water jet or wire EDM, however the current state of development of laser cutting apparatus limits the depth of cut, so thick slabs may have to be cut with the other techniques. Conventional cutting techniques may be used for the 220VC type Nitinol since it is easier to machine.

The liner pieces 226 are formed as illustrated in FIG. 34 by heating them to an elevated temperature between 600° C. and 950° C., preferably about 800° C., and pressing them into a die 228 having a die cavity with a cylindrical forming surface 230. The radius of curvature of the die cavity cylindrical forming surface 230 is equal to the desired outside radius of curvature of the segment 214. The pressing of the the liner pieces 226 into the die cavity 230 is done preferably with a matched male die (not shown) having a cylindrical die surface with a radius of curvature about equal to the radius of the bore of the barrel 208. The segment is held in the die until it cools to a cool temperature below 300° C., preferably about 200° C. and is then removed from the die 228.

The faying surfaces of the segment edges 220 in the assembled barrel liner 210 should match closely without gaps, so they are preferably ground to provide exactly matching surfaces in the assemble barrel 208. The grinding may be done with a CNC grinding apparatus using a PCBN grinding wheel or belt. The depth of cut should be relatively shallow, on the order of 0.001"–0.003" and the feed speed should be slower than conventional grinding.

Obviously, numerous modification and variations of the described preferred embodiments will occur to those skilled in the art in light of this specification. For example, new formulations of nickel-titanium compositions will continue to be developed and these compositions may be logical candidates for use in this invention. Also, many functions and advantages are described for the preferred embodiments, but in some uses of the invention, not all of these functions and advantages would be needed. Therefore, we contemplate the use of the invention using fewer than the complete set of noted functions and advantages. Moreover, numerous species and embodiments of the invention are disclosed herein, but not all are specifically claimed, although all are covered by generic claims. Nevertheless, it is my intention that each and every one of these species and embodiments, and the equivalents thereof, be encompassed and protected within the scope of the following claims, and no dedication to the public is intended by virtue of the lack of claims specific to any individual species. Accordingly, it is expressly to be understood that all the disclosed species and embodiments, and the numerous modifications and variations, and all the equivalents thereof, are to be encompassed within the spirit and scope of the invention as defined in the following claims, wherein I claim:

1. A gun barrel for a gun, comprising:

an elongated tube having a breech end and a muzzle end, and having an axial bore extending completely through said tube from said breech end to said muzzle end;

said axial bore through said tube having a contact surface for guiding a projectile toward a target and for containing propellant gasses behind said projectile;

said tube and said contact surface being made substantially entirely of Nitinol.

2. A gun barrel as defined in claim 1, wherein:

said tube is made of a Nitinol composition having a transition temperature lower than the lowest ambient temperature at which a gun with said barrel is designed to be operated.

3. A gun barrel as defined in claim 2, wherein:

said tube is made of a Nitinol formulation having said transition temperature below about −30° C.

4. A gun barrel as defined in claim 2, wherein:

said tube is made of a composition consisting essentially of 56% nickel and 44% titanium.

5. A gun barrel as defined in claim 1, further comprising:

a first sleeve of a nickel-titanium composition having a Martensite state and an Austenite state existing naturally on opposite sides of a transition temperature, said sleeve surrounding said tube and pretensioned thereon to exert a compressive preload on said tube and couple said sleeve mechanically to said tube.

6. A gun barrel as defined in claim 5, further comprising:

said nickel-titanium composition of said sleeve has a transition temperature higher than the designed normal upper temperature limit of said gun, whereby said sleeve composition remains in said Martensite state during normal operation of said gun and provides substantial damping of vibrations and whipping of said gun barrel in operation.

7. A gun barrel as defined in claim 5, wherein:

said nickel-titanium composition of said sleeve is free of cobalt and has a transition temperature lower than the designed normal upper temperature limit of said gun, whereby said sleeve composition remains in said Austenite state during normal operation of said gun and provides substantial compressive preloading of said tube during operation.

8. A gun barrel as defined in claim 1, wherein:

said axial bore of said elongated tube is rifled to impart an axial rotation to said projectile as said projectile passes through said bore.

9. A gun barrel for a gun, comprising:

an elongated tube having a breech end and a muzzle end, and having an axial bore extending completely through said tube from said breech end to said muzzle end;

said axial bore through said tube having a contact surface for guiding a projectile toward a target and for containing propellant gasses behind said projectile;

said tube and said contact surface being made of a nickel-titanium intermetallic compound;

a first sleeve of a nickel-titanium composition having a Martensite state and an Austenite state existing naturally on opposite sides of a transition temperature, said sleeve surrounding said tube and pretensioned thereon to exert a compressive preload on said tube and couple said sleeve mechanically to said tube;

said nickel-titanium composition of said first sleeve has a transition temperature lower than the designed normal lower temperature limit of said gun, whereby said sleeve composition remains in said Austenite state during normal operation of said gun and provides substantial compressive preloading of said tube during operation;

said gun barrel further comprising a second sleeve of a nickel-titanium composition having a transition temperature higher than the designed normal operating temperature of said gun, whereby said second sleeve composition remains in its Martensite state during normal operation of said gun and provides substantial damping of vibrations and whipping of said gun barrel in operation.

10. A process for making a composite gun barrel, comprising:

cutting an axial bore longitudinally through an elongated gun barrel blank made of a first Nitinol composition to make a gun barrel liner having an outside diameter;

making a sleeve substantially entirely of a second Nitinol composition having a low transition temperature with an Austenitic state and a low temperature Martensitic state on opposite sides of said transition temperature, said sleeve having an original form with an inside diameter smaller than said outside diameter of said liner;

cooling said sleeve below said transition temperature;

radially expanding said sleeve from said original size to an expanded form, increasing the diameter thereof to a dimension slightly exceeding said outside diameter of said liner;

inserting said liner fully into said sleeve while the temperature of said sleeve is below said transition temperature and said sleeve is in said expanded form;

allowing said sleeve to warm to a temperature above said transition temperature and revert to said Austenitic state;

whereby said sleeve will shrink toward said original form and exert a strong compressive force on said liner to reinforce said liner against bursting pressures within said liner bore when a projectile is fired from said gun barrel.

11. A process for making a composite gun barrel as defined in claim 10, wherein:

said first Nitinol composition is 60 Nitinol.

12. A gun barrel for a gun as defined in claim 10, wherein:

said first Nitinol composition is Type 60 Nitinol.

13. A gun barrel for a gun as defined in claim 10, wherein:

said cooling step includes immersing said sleeve in liquid nitrogen.

14. A process of propelling projectiles through a gun barrel bore of a gun, comprising:

inserting said projectile into a bore of a breech structure of said gun, sealing said breech structure, and igniting a propellant in said breech structure behind said projectile;

propelling said projectile into said bore of said gun barrel with gas pressure from said burning propellant;

engaging a soft metal surface of said projectile with rifling in interior walls of said bore of said gun barrel and engraving grooves in said projectile with said rifling, said interior walls of said bore consisting essentially of a monolithic Nitinol composition;

resisting corrosive attacks on said interior walls of said bore from said propellant gasses and particles of said projectile by chemical inertness of said Nitinol composition;

retarding transfer of heat to said gun barrel by low friction between said interior walls of said gun barrel bore and said projectile, and retarding conduction of heat from said bore to radial outer regions of said gun barrel by a low coefficient of thermal conductivity of said Nitinol composition, thereby causing a slow rate of temperature increase of said gun barrel during firing.

15. A process as defined in claim 14, wherein:

said gun barrel consists essentially of Nitinol.

16. A gun barrel for a gun performing the process defined in claim 14, wherein:

said breech structure has an outside diameter and an axial bore with an inside diameter sized to receive said projectile and a propellant charge for reacting in said breech to generate propellant gasses for propelling said projectile from said gun;

said barrel projecting from said breech structure in axial alignment therewith, said barrel having an axial bore aligned axially with said breech structure bore for guiding said projectile propelled from said breech structure by said propellant gasses;

a sleeve of a Nitinol composition surrounding said breech structure, said composition having a Martensitic state below a transition temperature and an Austenitic state above said transition temperature and having shape memory characteristics whereby said sleeve may be pseudo-plastically deformed from an original shape to a deformed shape while in said Martensitic state and exerts a force when constrained from returning to said original shape when heated above said transition temperature;

said sleeve in said original shape having an inner diameter smaller than said outside diameter of said breech structure, and exists in a state of high tension by virtue of shape memory contraction onto said breech structure after being expanded while in a Martensitic state and then allowed to warm above said transition temperature while positioned around said breech structure, and exerting a powerful radial force on said breech structure to prestress said breech structure in compression;

whereby said breech structure can withstand peak pressures of greater magnitude than a breech structure made of conventional breech materials and construction of comparable weight.

17. A gun barrel for a gun as defined in claim 16, wherein:

said sleeve overlaps said breech structure and said barrel and holds said barrel and said breech structure together.

18. A gun barrel for a gun as defined in claim 16, wherein:

said bore of said barrel has a contact surface that is substantially entirely monolithic Nitinol.

19. A gun barrel for a gun as defined in claim 19, wherein:

said contact surface of said bore is substantially entirely monolithic Type 60 Nitinol.

20. A gun barrel for a gun as defined in claim 18, wherein:

said contact surface is on a barrel liner of monolithic Nitinol coaxially surrounded by and under compression from said sleeve.

* * * * *